US010184667B2

(12) United States Patent
Faraldi et al.

(10) Patent No.: US 10,184,667 B2
(45) Date of Patent: Jan. 22, 2019

(54) STEAM OVEN CLEANING METHOD

(71) Applicant: Electrolux Appliances Aktiebolag, Stockholm (SE)

(72) Inventors: Paolo Faraldi, Forli (IT); Claire Banz, Zurich (CH); Giovanni Di Piano, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/126,319

(22) PCT Filed: Mar. 12, 2015

(86) PCT No.: PCT/EP2015/055213
§ 371 (c)(1),
(2) Date: Sep. 15, 2016

(87) PCT Pub. No.: WO2015/172909
PCT Pub. Date: Nov. 19, 2015

(65) Prior Publication Data

US 2017/0082295 A1 Mar. 23, 2017

(30) Foreign Application Priority Data

May 16, 2014 (EP) ..... 14168594

(51) Int. Cl.
*F24C 14/00* (2006.01)

(52) U.S. Cl.
CPC ..... *F24C 14/005* (2013.01)

(58) Field of Classification Search
None
See application file for complete search history.

(56) References Cited

U.S. PATENT DOCUMENTS 5,499,577 A * 3/1996 Tommasini ..... F24C 14/005 126/21 A
6,478,034 B1 * 11/2002 Durth ..... F24C 14/005 134/167 R (Continued)

FOREIGN PATENT DOCUMENTS

DE 4243947 6/1994
DE 19838864 A1 3/2000

(Continued)

OTHER PUBLICATIONS

International Search Report issued in PCT/EP2015/055213 dated Jun. 8, 2015, 3 pages.

(Continued)

*Primary Examiner* — Katelyn B Whatley
(74) *Attorney, Agent, or Firm* — Pearne & Gordon LLP

(57) ABSTRACT

A method for cleaning a cavity of an oven having a steam generation device, comprising the following steps: (i) a step of mild detergent cleaning, comprising (i.1) a step of applying mild detergent to the oven cavity at a predetermined cavity starting temperature ($T_0$), and subsequently (i.2) a step of incubating the oven cavity for a predetermined incubation period of time ($\Delta t_{inc1}$) at a temperature $T_{act}$, (i.3) a step of applying steam generated by the steam generation device to the oven cavity for a steam period of time ($\Delta t_{steam1}$) until the oven cavity reaches a temperature $T_1$, and subsequently incubating the oven cavity for an incubation period of time ($\Delta t_{inc2}$) until the oven cavity reaches a temperature $T_2$, and (i.4) a step of removing water and dirt from the oven cavity; and (ii) a step of steam cleaning, comprising (ii.1) a step of applying steam generated by the steam generation device to the oven cavity for a steam period of time ($\Delta t_{steam2}$) until the oven cavity reaches a temperature $T_3$, and subsequently incubating the oven cavity for an incubation period of time ($\Delta t_{inc3}$) until the oven cavity (Continued)

reaches a temperature $T_4$, and (ii.2) a step of removing water and dirt from the oven cavity.

26 Claims, 3 Drawing Sheets

(56) References Cited

U.S. PATENT DOCUMENTS

| | | | | |
|---|---|---|---|---|
| 2009/0288683 | A1* | 11/2009 | Cummings | C11D 3/3942 134/19 |
| 2011/0266271 | A1* | 11/2011 | Boyer | F24C 14/005 219/393 |
| 2012/0118321 | A1* | 5/2012 | Neplenbroek | C11D 3/0057 134/7 |

FOREIGN PATENT DOCUMENTS

| | | | |
|---|---|---|---|
| DE | 10049161 | A1 | 4/2002 |
| EP | 1557612 | A1 | 7/2005 |
| EP | 1953458 | A1 | 8/2008 |
| GB | 1284770 | A | 8/1972 |
| WO | 2010065481 | A1 | 6/2010 |

OTHER PUBLICATIONS

Examination Report issued in counterpart EP Appl'n. No. 14168594.1, dated Jul. 17, 2017, 10 pages.

* cited by examiner

Steam cleaning detergent assisted process thermal history example STEP 1

Steam cleaning detergent assisted process thermal history example STEP 2

STEAM OVEN CLEANING METHOD

BACKGROUND OF THE INVENTION

The present invention relates to a method for cleaning a cavity of an oven having a steam generation.

It is known in the art that if foodstuffs are cooked in a cavity of an oven soiling by splatters or vapors may occur, particularly by spreading cooking liquids, fat or the like on the walls of the oven, particularly of the lateral walls, bottom, door, back fan cover and roof, of a cavity.

For a long time, there is a need for a time, cost and purpose efficient and, moreover, safe way for cleaning ovens and oven cavities from such soiling.

Several attempts are known in the art, which, however, still are dissatisfying.

As detergents specific for oven cleaning, typically, very aggressive substances have to be applied in order to achieve a sufficient cleaning capacity, especially if burnt and dehydrated soil has to be removed. Therefore, strong detergents are usually applied, e.g. high alkaline detergents, for example, based on sodium hydroxide or the like. In accordance therewith, the use of such detergents is known to be unpleasant and prone to health and safety risks.

Where the application of such cleaners is to be avoided, methods using the features of ovens, such as heating, are applied or the oven interior is designed for facilitated cleaning.

Known methods involve pyrolysis and catalytic panels. These known methods are relatively effective for removing soil from the interior surfaces of ovens, however, show considerable disadvantages.

Pyrolysis, for example, is a process where high temperature of up to about 500° C. burns away soil. However, pyrolysis requires a long process time, for example up to 1 hour, and a significant amount of energy to keep the high temperature over the process time, and, moreover, safety concerns impose to lock the door during the whole process.

Catalytic coatings are also well known in the art, however, the effectiveness and the duration of such layers is typically limited, and, moreover, aesthetic appearance is typically poor.

A well-known approach to ease the oven cleaning operations is the so-called steam soaking, where dirt is rehydrated and softened, by exposing it to water vapor, that can be generated simply by pouring water on the oven cavity bottom and heating up, or, using the oven steam generation system where available.

The document EP 1 557 612 A1 describes a system for introducing moisture into an oven for cleaning.

In this way, if the amount of soil is fairly low, gentle scrubbing is enough to remove dirt, even without the help of detergents. This approach is unluckily insufficient if soil amount is elevated or soil has been "baked" on the walls by repeated cooking cycles.

SUMMARY OF THE INVENTION

It is an object of the present invention to provide an improved cleaning method for steam ovens using steam soaking.

A method for cleaning a cavity of an oven having a steam generation device according to a disclosed embodiment comprises at least the following steps:

(i) a step of mild detergent cleaning, comprising (i.1) a step of applying mild detergent to the oven cavity at a predetermined cavity starting temperature ($T_0$), and subsequently (i.2) a step of incubating the oven cavity for a predetermined incubation period of time ($\Delta t_{inc1}$) at a temperature $T_{act}$, (i.3) a step of applying steam generated by the steam generation device to the oven cavity for a steam period of time ($\Delta t_{steam1}$) until the oven cavity reaches a temperature $T_1$, and subsequently incubating the oven cavity for an incubation period of time ($\Delta t_{inc2}$) until the oven cavity reaches a temperature $T_2$, and (i.4) a step of removing water and dirt from the oven cavity; and (ii) a step of steam cleaning, comprising (ii.1) a step of applying steam generated by the steam generation device to the oven cavity for a steam period of time ($\Delta t_{steam2}$) until the oven cavity reaches a temperature $T_3$, and subsequently incubating the oven cavity for an incubation period of time ($\Delta t_{inc3}$) until the oven cavity reaches a temperature $T_4$, and (ii.2) a step of removing water and dirt from the oven cavity.

The present inventors have surprisingly found that in a method for cleaning a cavity of a steam oven, detergents, particularly if they are mild detergents, can be advantageously applied in a cleaning protocol comprising incubating the soil with steam generated by the steam generation device of such oven.

The present invention is so far turns away from the teaching of the prior art where the application of detergents is thought to be disadvantageous and thus best avoided, particularly if a steam process is applied in such method.

By contrast, the present invention is dedicated to steam ovens and meant to improve the basic steam soaking methods known in the art by integrating in an automatic cycle, the action of a mild detergent. Said mild detergent supports its action via a suitable combination of temperature, humidity and exposure time, eventually allowing good cleaning results also in case of heavy soiling.

A detergent as used herein, preferably, refers to a detergent, which is a surfactant or a mixture of surfactants having cleaning properties in dilute solutions. A detergent, more preferably, may be classified into three broad groups, depending on the electrical charge of the surfactants, the groups being anionic detergents, cationic detergents and non-ionic detergents. Typical anionic detergents, preferably, are selected from the group comprising alkylbenzenesulfonates, e.g. branched or linear sodium dodecylbenzenesulfonate and soap. Cationic detergents, preferably, comprise a hydrophobic component and, more preferably, a quaternary ammonium as its polar end. The ammonium center, most preferably, is positively charged. Non-ionic detergents are, preferably, characterized by their uncharged, hydrophilic head 2 groups. Typical non-ionic detergents are, more preferably, based on polyoxyethylene or a glycoside. Common examples of the former include Tween, Triton, and the Brij series. These materials are also known as ethoxylates or PEGylates. It will be understood that glycosides comprise a sugar as their uncharged hydrophilic head group. Examples include octyl thioglucoside and maltosides, and HEGA and MEGA series detergents which possess a sugar alcohol as head group. Zwitterionic detergents forming a subgroup of non-ionic detergents, preferably, possess a net zero charge arising from the presence of equal numbers of +1 and −1 charged chemical groups. Examples comprise CHAPS.

A mild detergent as used herein, preferably, refers to a detergent being safe for the user, preferably, safe on skin, i.e. not irritant, and more preferably, not damaging surfaces being in contact with, e.g. a surface of an oven cavity to be cleaned, i.e. being not corrosive.

In a preferred embodiment of the inventive method the mild detergent is selected from the group comprising anionic, cationic and non-ionic detergent.

For example, dish soap is considered a mild detergent. However, the person skilled in the art will know further mild detergents as referred to herein.

Moreover, a person skilled in the art will immediately understand and recognize that detergents based on acids, containing acids in an substantial amount or being acids as such are less suitable for the purpose intended by the present invention; particularly, acid based detergents are less suitable for the purpose of degreasing and/or decarbonisation as described in connection with the present invention. Therefore, in a preferred embodiment of the present inventive method a detergent, and particularly a mild detergent as used herein in connection with the present invention is a mild detergent having a neutral or basic pH-value.

In connection therewith, it will also be immediately understood that a mild detergent as referred to herein may or may not comprise such acid. If a mild detergent nevertheless comprises such acid the concentration of such acid in the detergent is as low that the mild detergent is still safe for the user, preferably, safe on skin, i.e. not irritant, and more preferably, not damaging surfaces being in contact with, e.g. a surface of an oven cavity to be cleaned, i.e. being not corrosive.

Preferably, a detergent as considered in the method according to the present invention is not an acid as such or and acid-based detergent, more preferably, a detergent is not a food acid or a food acid based detergent, most preferably, not citric acid or a citric acid based detergent or the like.

It is the merit of the present inventors having found that also mild detergents, if applied in the method according to the present invention are useful in cleaning an oven cavity, even if heavily soiled. Moreover, such application of mild detergents according to the present invention is, preferably, without a health risk, at least without a severe health risk. The present invention thus turns away from the teaching of the prior art that detergents, preferably, aggressive detergents, have to be applied to achieve desired results. By contrast and in way of example, when applying bleach, a person skilled in the art will immediately acknowledge that bleach is not a mild detergent and will poses significant risk to the skin and to health in general. Bleach can also burn through clothing if left there for an extended amount of time. Therefore, it is common practice to wear gloves when handling bleach because of these qualities. By contrast, such risk management is not necessary when practicing the method according to the present invention, as mild detergents are, preferably, selected such, that they are not harmful. Moreover, gloves are not to be necessarily worn to handle a mild detergent, for example, everyday hand soap.

Applying such mild detergent according to the present method, preferably, means to apply said detergent uniformly on the cavity surface. It has to be understood, however, that at a region where much soil is accumulated applying more detergent is not necessary but, preferably, will not be of disadvantage. However, a person skilled in the art will also recognize that a mild detergent will be applied in an appropriate amount sufficient to allow for an effective cleaning. However, it is also immediately clear that if too much detergent is applied it is possible that too much waste solution is generated in the cavity in the end of the inventive method and/or a step of removing water and dirt. A person skilled in the art will know the volume of mild detergent, which optimally is applied to the oven cavity, and particularly a maximum amount of mild detergent with regard to applicability by the used can be easily determined by the user itself or may be recommended by the manufacturer.

It will also be immediately understood that the order of steps carried out in the present method is particularly advantageous if, according to a preferred embodiment of the inventive method for cleaning a cavity of an oven having a steam generation device the steps are carried out in the following order:

(i) a step of mild detergent cleaning, and subsequently (ii) a step of steam cleaning.

In a further preferred embodiment of the inventive method a step (i) of mild detergent cleaning comprises the following steps to be carried out in the following order:

(i.1) a step of applying mild detergent to the oven cavity at a predetermined cavity starting temperature ($T_0$), and subsequently (i.2) a step of incubating the oven cavity for a predetermined incubation period of time ($\Delta t_{inc1}$), at a certain activation temperature $T_{act}$, wherein preferably, said temperature $T_{act}$ is generated either by performance of a steam generator or by standard heating elements, or both, and subsequently (i.3) a step of applying steam generated by the steam generation device to the oven cavity for a steam period of time ($\Delta t_{steam1}$) until the oven cavity reaches a temperature $T_1$, and subsequently incubating the oven cavity for an incubation period of time ($\Delta t_{inc2}$) until the oven cavity reaches a temperature $T_2$, and subsequently (i.4) a step of removing water and dirt from the oven cavity; and In a further preferred embodiment of the inventive method a step (ii) of steam cleaning comprises the following steps to be carried out in the following order:

(ii.1) a step of applying steam generated by the steam generation device to the oven cavity for a steam period of time ($\Delta t_{steam2}$) until the oven cavity reaches a temperature $T_3$, and subsequently incubating the oven cavity for an incubation period of time ($\Delta t_{inc3}$) until the oven cavity reaches a temperature $T_4$, and (ii.2) subsequently, a step of removing water and dirt from the oven cavity.

In connection with a step (ii) of steam cleaning it will be immediately understood that, preferably, a condensation of steam removes detergent residuals and, more preferably, remaining traces of soil. In connection therewith, it is immediately clear that condensation is advantageous and preferred in a step (ii.1). This, preferably, allows condensation itself to remove detergent residuals and remaining traces of soil.

In a preferred embodiment of the inventive method the method further comprises a door locking and/or unlocking step.

It will be understood that it is of particular advantage that a door for closing the cavity cannot be opened in particular steps of the inventive method. For example, the door could be locked during a step of applying steam.

In a further preferred embodiment of the inventive method is an automated, preferably, semi-automated, method, wherein the method is carried out after selection of the method and, wherein the oven comprises a storage unit, wherein the inventive method is stored and operated from.

Where the method is a semi-automated method, the user has to manually perform steps of the inventive method, e.g. a step of removing water and dirt from the cavity. In such situation the oven, more particularly, the user interface of such oven, preferably, instructs the user when and/or what has to be carried out. E.g. the user interface may indicate to open the door and/or to apply detergent and, preferably, which detergent and how, or how much.

In a further preferred embodiment of the inventive method a signal, such as an acoustic or optical signal is performed by the oven, when a certain step begins or is ended. Such oven may comprise a user interface, which, for example, allows selection of the method and/or the program to be operated, e.g. an OFF mode, a cooking mode or method, or an inventive cleaning method. Such interface may also allow the user to select and adjust a temperature within the oven cavity as well as the amount and/or the temperature of steam applied to the oven cavity. Such user interface may also comprise a display informing the user of the status of the method carried out. Thus, the user is informed when the method will end and/or when the user has to perform an action. The oven may also comprise a temperature sensor and/or a food probe for determining the temperature in the cavity. Such temperature sensor and/or a food probe is of advantage in controlling and performing the inventive method in that such temperature sensor and/or a food probe allows to determine the temperature in the cavity and thus to determine whether, for example a desired predetermined temperature is reached. Accordingly, various steps of the inventive method may comprise an at least one step of determining the temperature in the oven cavity. Particularly, where the end of a step is defined as "until the oven cavity reaches a temperature of" it is to be understood with such temperature sensor and/or a food probe the exact time point may be determined by measuring the temperature. Where such temperature sensor and/or a food probe is not present, however, it is to be understood that the time interval may nevertheless be determined by calculation and/or manufacturers experience, preferably, within a certain magnitude of error.

In an advantageous embodiment of the inventive method said cavity starting temperature ($T_0$) is about room temperature and/or said temperature $T_{act}$ is between about room temperature and about 60°.

In accordance therewith, a step of mild detergent cleaning starts at about room temperature.

As used herein room temperature, preferably, refers to a temperature of 21° C. under normal conditions.

In a preferred embodiment of the inventive method said activation temperature $T_{act}$ ranges from about room temperature to about 600, preferably, about 50° C. for mild detergents. Where the mild detergent is an enzyme based detergent it a temperature $T_{act}$ is preferred ranging from about 36 to about 40° C.

$T_{act}$ thereby is reached and generated either by steam generation or by operation of standard heating elements, or by both.

In an advantageous embodiment of the inventive method said temperature $T_1$ is equal to or less than about 100° C. or is higher than about 50° C., preferably, is between about 50° C. and about 100° C., and, more preferably, is between about 50° C. and about 95° C.

In said steam period of time $\Delta t_{steam1}$ and $\Delta t_{steam2}$ steam is introduced into the oven cavity for introducing heat and moisture into the oven cavity. Preferably, a steam generating device is connected to the oven cavity of introducing heat and moisture into the oven cavity. An oven as used herein, preferably, is a steam oven.

In an advantageous embodiment of the inventive method said temperature $T_3$ is equal to or less than about 100° C. or higher than about 65° C., preferably, is between about 65° C. and about 100° C., more preferably, is between about 65° C. and about 95° C.

In an advantageous embodiment of the inventive method a step i.1 of applying mild detergent to the cavity is performed manually by the user and/or wherein a step of i.3 and/or a step of ii.2 of removing water and dirt from the oven cavity is performed manually by the user.

In a preferred embodiment of the present invention, a step of mild detergent cleaning comprises a step of opening and/or closing a door. For, example a step (i.1) of applying mild detergent to the oven cavity at a predetermined cavity starting temperature ($T_0$), may comprise a step of opening a door prior to said step of applying mild detergent. Moreover and subsequently to said step of applying mild detergent, the step (i.1) may comprise a step of closing a door, followed by a step of incubating the oven cavity for a predetermined incubation period of time ($\Delta t_{inc1}$) at temperature $T_{act}$. In connection therewith, a door preferably, is a door for closing the oven cavity. In other words, a user may open a door apply the detergent and close the door afterwards for starting the incubation step for predetermined incubation period of time $\Delta t_{inc1}$.

In an embodiment where applying mild detergent to the cavity is performed manually by the user such application may be processed in various ways. For example, the user may spray a liquid solution of or comprising the detergent into the cavity and moisten the cavity walls therewith.

A step of removing water and dirt from the oven cavity may also be performed manually by the user. For example, the user may use a mop or a sponge to remove water and dirt from the oven cavity. Accordingly, a step of removing water and dirt from the oven cavity may also comprise a step of opening a door prior to such step of removing water and dirt and/or may comprise a step of closing a door after such step of removing water and dirt.

In an advantageous embodiment of the inventive method said temperature $T_2$ is less than about temperature $T_1$ and/or higher than about 40° C.

In an advantageous embodiment of the inventive method said temperature $T_4$ is less than about 95° C. and/or higher than about 50° C.

In an advantageous embodiment of the inventive method a step i.3 of removing water and dirt from the oven cavity is carried out subsequent to a step of cooling the cavity to a working temperature ($T_{work1}$), wherein, preferably, said working temperature ($T_{work1}$) is about room temperature.

In an advantageous embodiment of the inventive method a step ii.2 of removing water and dirt from the oven cavity is carried 2 out subsequent to a step of cooling the cavity to a working temperature ($T_{work2}$), wherein, preferably, said working temperature ($T_{work2}$) is about room temperature.

It will be understood that such working temperatures, i.e. $T_{work1}$ and/or $T_{work2}$ are the temperatures where preferably, a user has to carry out an action, such as carrying out a step of removing water and dirt from the cavity. It will be immediately understood that such work is preferably, carried out by the user after such step of cooling the cavity to a working temperature.

A working temperature thus, preferably, is a temperature, where a user is not at risk of burnings.

Such cooling step may be a simple passive cooling down by surrounding temperature, however, may also be carried out by an active cooling system, e.g. of the oven, for example, by a fan of the oven.

It will be understood that after such cooling step a user may open the cavity and perform its action such as a step of removing water and dirt without the risk of burning.

In an advantageous embodiment of the inventive method said mild detergent is selected from the group comprising a basic mild detergent and an enzyme based mild detergent and a mixture thereof.

A basic mild detergent as used herein, preferably, refers to a mild detergent having a basic pH-value.

In an advantageous embodiment of the inventive method said basic mild detergent is or is a composition comprising a detergent selected from the group comprising anionic, cationic and non-ionic detergent, more preferably, an anionic detergent selected from 2 the group comprising dish soap, sodium hydroxide, phosphonate, sulphonate and other anionic surfactants.

An enzyme based mild detergent, as user herein, preferably, comprises at least one enzyme in an amount of about 0.4% to about 0.8% by weight. Such enzyme, for example, a protease, can be advantageously used to degrade effectively protein based food debris. Such enzyme-based mild detergent can be applied in addition to other detergent components, e.g. surfactants, peroxides, etc.

In an advantageous embodiment of the inventive method said mild detergent is a basic mild detergent and wherein the temperature $T_1$ and/or $T_2$, and/or, $T_3$ and/or $T_4$ is higher than about 60° C., preferably, higher than 75°, higher than 80°, preferably, higher than 85°, and more preferably, is about 90°.

In connection therewith, it is to be understood that in a first step i) of mild detergent cleaning and in a second step ii) of steam cleaning a temperature of above about 60° C. is preferred. However, it is the present inventors are convinced that at the end of step i) and/or step ii) a cavity temperature being about 60° C. is of advantage. More particularly, the use of the detergent in association of the temperature in a range of about 50° C. to about 60° C. is understood to support the cleanability.

In an advantageous embodiment of the inventive method said mild detergent is an enzyme and wherein the temperature $T_{act}$, $T_1$ and/or $T_2$ and/or $T_3$ and/or $T_4$ is each individually from about 40° C. to about 50° C.

However, it is also immediately clear to a person skilled in the art that—as enzyme-catalyzed reactions are saturable—the rate of catalysis of a particular does not show a linear response to increasing substrate.

The method according to the present invention and/or a step of said method may comprise a step of enzyme based detergent treatment and/or incubation.

For enzyme treatment a defined and stable temperature level such a step of enzyme treatment is advantageous to have enzymes performing their action. This is important particularly in the incubation phases of the inventive method. Moreover, to avoid permanent deactivation of enzymes themselves, it is mandatory to carefully control the maximum temperature achieved during steam application.

A person skilled in the art will immediately understand that each enzyme will have a particular advantage temperature where the enzyme optimally exhibits its enzyme activity. In connection therewith, it will be immediately understood that an optimal enzyme activity is also a measure of the optimal quantity of active enzyme present and is thus dependent on conditions, which can be easily specified by a skilled person. A person skilled in the art will know the optimal temperature for each particular enzyme.

On the other hand one particular condition which is important for having an optimal enzyme activity is the said temperature. It will be thus immediately understood by a skilled person that such optimal temperature for the specific enzyme is advantageous, however, may not be present during the whole inventive method. It is thus also considered therein, that temperatures are reached during the inventive method which will at least partially destroy enzymes present. This is particularly the case where an enzyme is applied having a narrow range of temperature in which its activity is optimal, e.g. a protease.

In such case, an enzyme will be active in an incubation period at a temperature preferably, about the enzymes optimal temperature, and subsequently and optionally said enzyme is destroyed in a step comprising heating and/or applying steam.

In an embodiment of the present invention, the enzyme is an enzyme having a relatively high thermo-stability. In connection therewith, it will be understood that each particular enzyme will denature at a certain temperature.

In an advantageous embodiment of the inventive method a duration of the step (i) of mild detergent cleaning is about 35 min to 42 min, and preferably, the incubation period $\Delta t_{inc1}$ is between about 200 sec and about 600 sec, more preferably, is in between about 300 sec and no more than about 600 sec, most preferably, between about 360 sec to about 600 sec., and/or wherein the incubation period $\Delta t_{inc2}$ is between 30 min and about 40 min, preferably, about 43 min and/or wherein the steam period $\Delta t_{steam1}$ is about 10 min.

In an advantageous embodiment of the inventive method a duration of the step (i) of mild detergent cleaning is about 35 min to 42 min.

The duration of an incubation period $\Delta t_{inc1}$, preferably, is between about 200 sec and about 600 sec, more preferably, is between about 300 sec to no more than about 600 sec, most preferably, is between about 360 sec and about 600 sec.

The duration of a steam generation phase $\Delta t_{steam1}$ preferably, is no more than about 15 min in order to avoid too much water on the bottom of the cavity oven.

The duration of an incubation period $\Delta t_{inc2}$, preferably, is between about 30 min and about 40 min, more preferably, about 43 min.

However, it will be understood that said incubation period $\Delta t_{inc2}$ comprises a soaking phase, preferably, having a duration of about 5 to about 30 min, preferably, about 10 to about 15 min, where the steam generator keeps the temperature at a predetermined constant temperature $T_{act}$.

In a preferred embodiment $T_{act}$ is about 10° C. to about 20° C. lower than the target of soaking phase.

More preferably, said incubation period $\Delta t_{inc2}$ comprises a cool down phase.

Preferably, said cool down phase is performed subsequent to the soaking phase.

In a preferred embodiment, said cool down phase has a duration of about 10 min in order to get the oven around $T_{work1}$, preferably, being about 60° C., and allowing user operation.

It will, however be understood that, preferably in said cool down phase the cavity is allowed to cool down until an appropriate working temperature $T_{work1}$ is reached.

In an advantageous embodiment of the inventive method a duration of the step (ii) of steam cleaning is about 20 min to about 45 min, preferably, about 30 min to about 35 min, more preferably, about 33 min, and preferably, the incubation period $\Delta t_{inc3}$ is between about 15 min and about 30 min, more preferably, about 25 min and/or wherein the steam period $\Delta t_{steam2}$ is about 500 s.

Preferably, the duration of an incubation period $\Delta t_{inc3}$ is more than about 15 min, which is thought to be a minimal duration for $\Delta t_{inc3}$ to reach the desired effect.

Preferably, a incubation period $\Delta t_{inc3}$ comprises a cool down phase, more preferably, said cool down phase has a duration of about 10 min.

It is preferred that said cool down phase of $\Delta t_{inc3}$ is performed at the end of and/or subsequent to incubation period $\Delta t_{inc3}$ All described embodiments of the invention have the advantage, that cleaning of oven cavity of a steam oven is improved by integration, in an automatic cycle, the action of a mild detergent.

The present invention will be described in further detail with reference to the drawings, in which

DETAILED DESCRIPTION OF PREFERRED EMBODIMENTS

Figure 1:
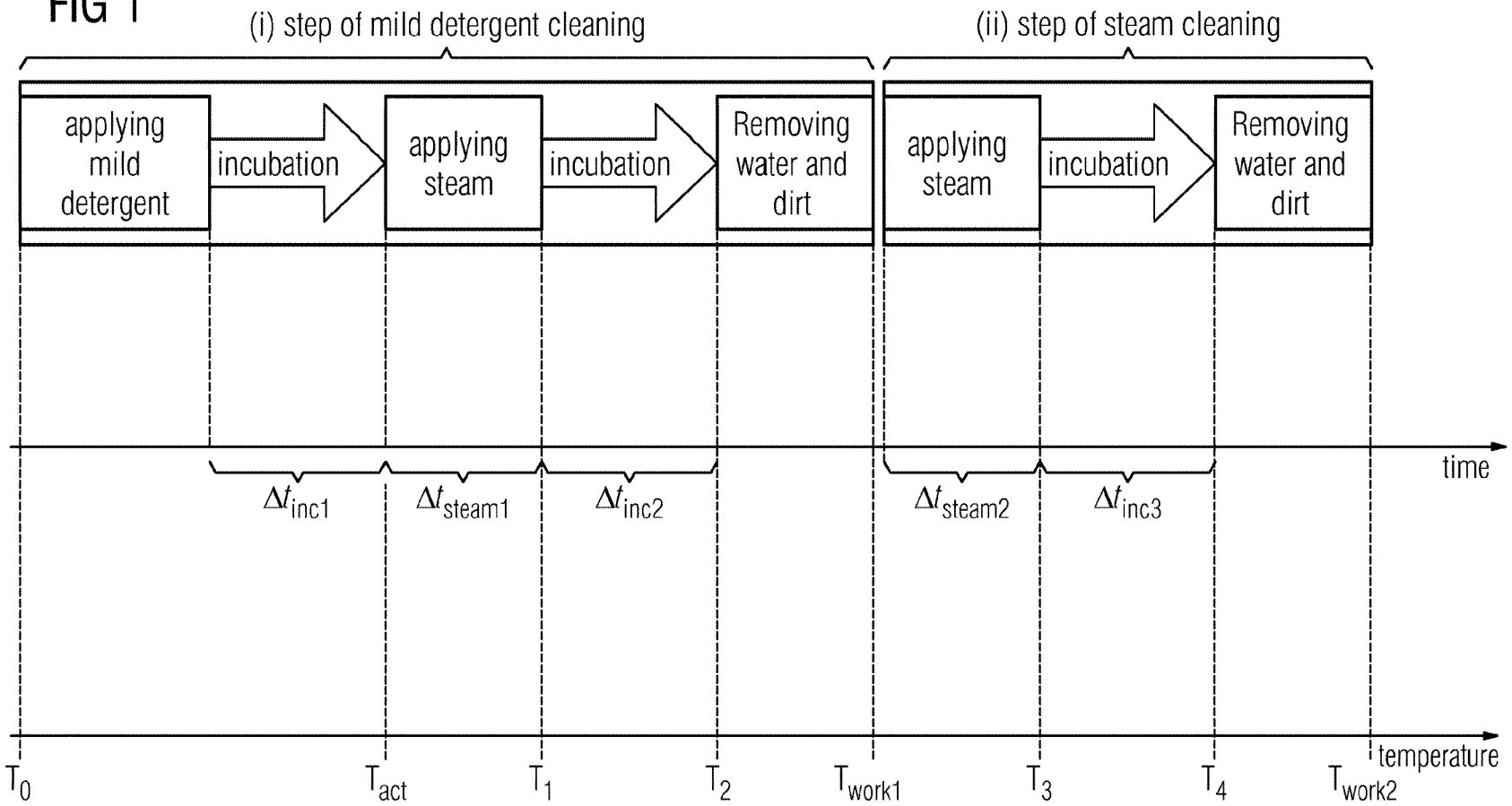
FIG. 1 illustrates a schematic overview of the sequence of steps of the inventive method.

FIG. 1 schematically shows the sequence of steps of the inventive method.

The present invention relates to an automated oven cleaning process, particularly for a food cooking steam oven, adapted to cook foods by introducing steam into the cooking cavity, where the action of a detergent is integrated in the process itself to enhance effectiveness against heavy soiling.

Therefore, at first in a step (i.1) a mild detergent is applied to the oven cavity as part of a step (i) of mild detergent cleaning. Said step (i) of mild detergent cleaning, further comprises subsequent to the step (i.1) of applying mild detergent to the oven cavity at a predetermined cavity starting temperature ($T_0$), a step of incubating the oven cavity for a predetermined incubation period of time ($\Delta t_{inc1}$). Afterwards, in a step (i.2) steam generated by the steam generation device and thereby heat and moisture is applied to the oven cavity for a steam period of time ($\Delta t_{steam1}$) until the oven cavity reaches a temperature $T_1$. Subsequent thereto the oven cavity is incubated for an incubation period of time ($\Delta t_{inc2}$) until the oven cavity reaches a temperature $T_2$. However, said incubation period of time ($\Delta t_{inc2}$) may comprise a soaking phase and a cool down phase. The soaking phase may have a duration of about 5 to about 30 min, preferably, about 10 to about 15 min, where the steam generator keeps the temperature at a constant temperature, preferably, about 10° C. to about 20° C. lower than the target of soaking phase. Subsequently, a cool down phase having a duration of about 10 min may be performed until the oven cavity reaches a temperature $T_{work1}$, preferably, being about 60° C., and allowing user operation.

It will, however be understood that in said cool down phase the cavity is allowed to cool down until an appropriate working temperature $T_{work1}$ is reached.

Thus, also in the incubation period ($\Delta t_{inc2}$) steam may be further advantageously applied, preferably, during the soaking phase, to keep the desired target temperature.

Preferably, a incubation period $\Delta t_{inc3}$ comprises a cool down phase, more preferably, said cool down phase has a duration of about 10 min.

Finally, in a step of (i.3) water and dirt from the oven cavity is removed. Said step (i) of mild detergent cleaning is followed by a step (ii) of steam cleaning, comprising, at first a step (ii.1) of applying steam generated by the steam generation device to the oven cavity, and thus heat and moisture, for a steam period of time ($\Delta t_{steam2}$) until the oven cavity reaches a temperature $T_3$. Afterwards, the oven cavity is incubated for an incubation period of time ($\Delta t_{inc3}$) until the oven cavity reaches a temperature $T_4$. However, within said incubation period of time ($\Delta t_{inc3}$) steam may be further advantageously applied, to keep the desired target temperature.

However, said incubation period of time ($\Delta t_{inc3}$) may comprise a soaking phase and a cool down phase, wherein in the soaking phase the steam generator keeps the temperature at a constant temperature, preferably, about 10° C. to about 20° C. lower than the target of soaking phase.

Preferably, the duration of an incubation period $\Delta t_{inc3}$ is more than about 15 min, which is thought to be a minimal duration for $\Delta t_{inc3}$ to reach the desired effect.

A cool down phase preferably, has a duration of about 10 min, until the oven cavity reaches a temperature $T_{work2}$, preferably, being about 60° C., and allowing user operation. It will, however be understood that in said cool down phase the cavity is allowed to cool down until an appropriate working temperature $T_{work2}$ is reached.

Thus, also in the incubation period ($t_{inc3}$), preferably, in the soaking phase, steam may be further advantageously applied, to keep the desired target temperature.

The inventive method may be used as a steam cleaning detergent assisted process and is meant to be used in case of heavy soiling of the oven cavity. It will be immediately understood that it can be offered along with a standard steam assisted cleaning function, particularly, allowing the user to select the cleaning function most suitable for the contingency. A stem oven with full steam capabilities is preferred to perform the method comprising at least a steam generation device, more preferably, having a power to ensure quick and consistent saturation of the oven cavity environment. For example, a water evaporation capability in the range of 20 to 30 grams of water per second is typically sufficient for an oven cavity having 70 liter space.

It will be immediately understood that a person skilled in the art will select the particular parameters of the present inventive method according to ensure a sufficient amount of humidity condensation on oven cavity walls.

It will be immediately understood that the use of the steam generator instead of using any of possible other oven heating elements is of advantage.

Figure 2A:
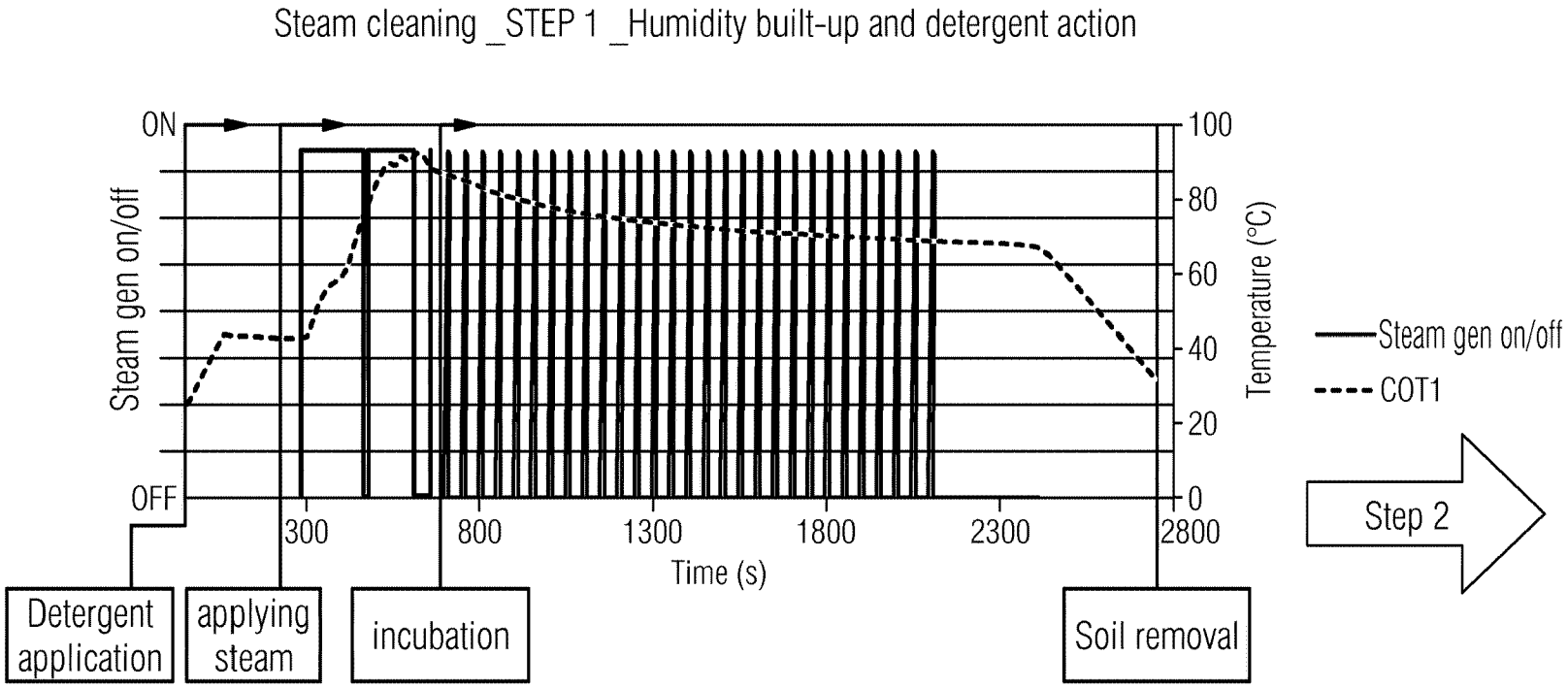
FIGS. 2A and 2B illustrate a power and temperature over time diagram showing the thermal history of a step of (i) and a step of (ii) of a first inventive embodiment.
Figure 2B:
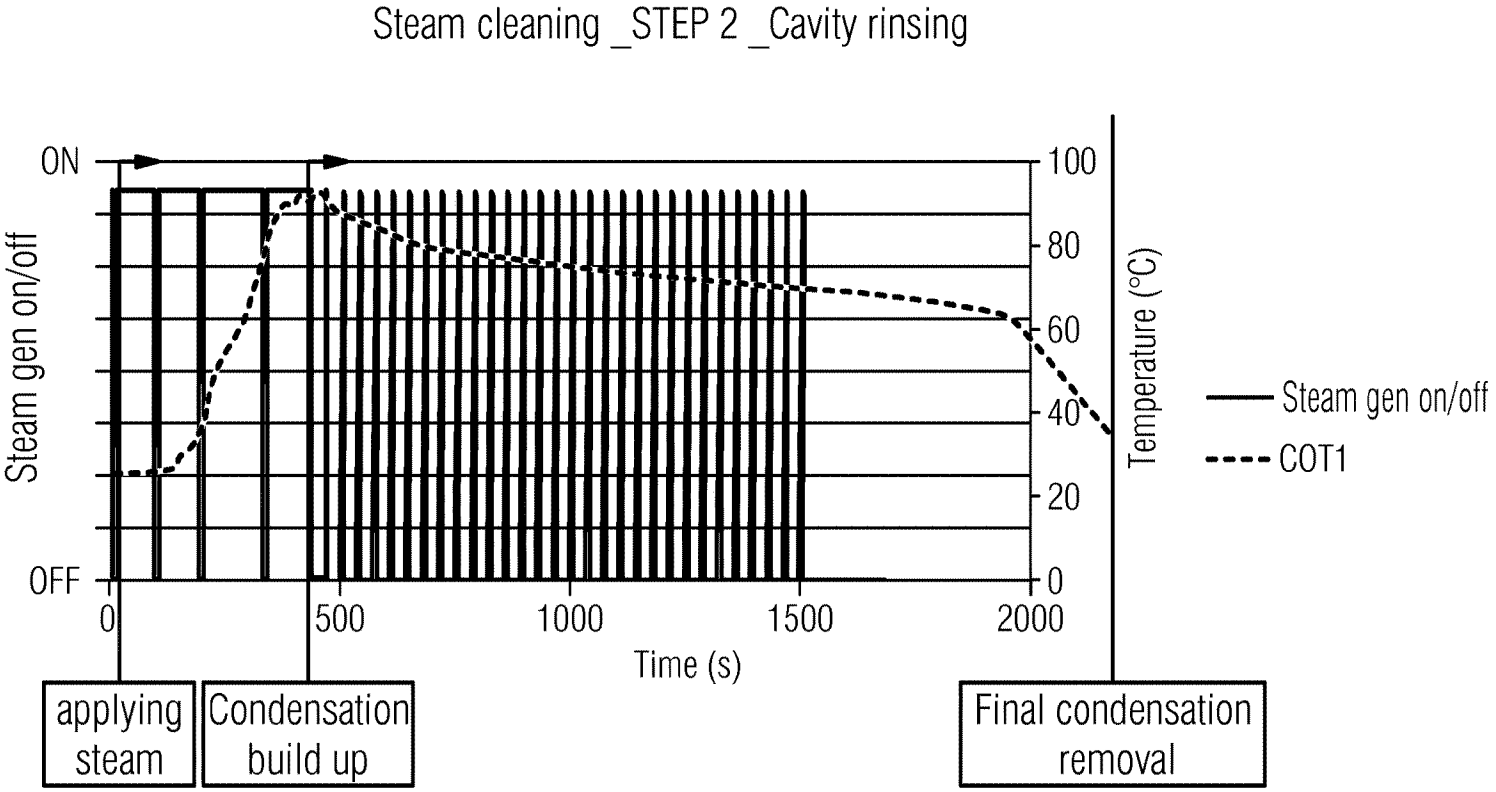

In FIGS. 2A and 2B a power and temperature over time diagram showing the thermal history of a step of (i) according to FIG. 2A and a step of (ii) according to FIG. 2B of a first inventive embodiment is shown.

The performed method and applied method parameters in said embodiment shown in FIG. 2A and FIG. 2B was sufficient to clean the soiled oven cavity. Thereby a cavity of a steam oven which is heavily soiled by extensive use may be cleaned. Such steam oven, and, particularly, the cavity thereof can be readily cleaned to a sufficient and desired extend with the inventive method according to the first inventive embodiment, the parameters of which are shown in FIGS. 2A and 2B.

The method parameters and a diagram showing the thermal history of the method according to said first embodiment is shown in FIGS. 2A and 2B.

Here a diagram is shown where the left y-axis indicates whether the steam generator generates steam (ON) or not (OFF), the right y-axis indicates the temperature in the oven cavity in ° C., and time is depicted on the x-axis in seconds (s). Thereby, COT1 refers to CENTER OVEN TEMPERATURE, which is known to the person skilled in the art as a standard measurement of the temperature inside the oven.

In the method of the present invention carried out according to FIGS. 2A and 2B a grease remover-decarbonizer detergent for ovens liquid was applied which forms a gel that clings to the surface when sprayed. Said detergent is an alkaline product to remove all traces of grease, carbon deposits and soot from ovens.

The detergent was applied in an amount of about 50 to about 100 g. Incubation period $\Delta t_{inc1}$ was set to 10 min.

The inventive method is performed with a temperature $T_0$ being room temperature, $T_{act}$ being 50° C., $T_1$ being 95° C., $T_2$ being 70° C., $T_3$ being 90° C. and $T_4$ being 65° C.

In FIG. 2A a step (i) of mild detergent cleaning is monitored and in FIG. 2B a step (ii) of steam cleaning is monitored.

The process comprises said two steps through which the user is driven by messages shown on the user interface of the oven.

As may be taken from FIG. 2A the step (i) of mild detergent cleaning has a duration of only some minutes for manual cleaning, using not abrasive sponges, warm water and, in case of very strong soiling, more mild detergent.

The oven is at $T_0$, i.e. room temperature, and the user opens the door for closing a cavity opening, and sprays the oven detergent inside the cavity uniformly. Afterwards the door is closed by the user. After closing the door, a settle time $\Delta t_{inc1}$ is set at $T_{act}$, achieved by standard heating elements, to allow detergent action and incubation.

When the incubation period $\Delta t_{inc1}$ is elapsed, the steam generation starts, i.e. the door is locked, the steam, and thus moisture and heat, is inserted for a steam period of time $\Delta t_{steam1}$ into the cavity until the temperature $T_1$, here being between 80-95° C. is reached.

Here, $t_{steam1}$ is from about 5 to 15 min.

After reaching temperature $T_1$, some steam generator action is performed in order to allow soaking and to allow detergent action to happen until a temperature $T_2$ is reached, here being 70° C.

Afterwards a cool down phase is performed wherein the oven cavity is allowed to cool down to manageable temperature, here said $T_{work1}$ is 40° C.

The door is unlocked and the user is introduced by the user interface to perform a step of removing water and dirt from the oven cavity. The user will thus open the door and cleans the oven cavity with a sponge, removing excess of residual water and dirt. After closing the door, the user is asked by the user interface to start step (ii) of steam cleaning.

As may be taken from FIG. 2B the step (ii) of steam cleaning has a duration of 1800 sec.

When room temperature is reached, or in order to not compromise the cleaning performance, at least a COT1 of no more than 40-45° C. is suggested, the step (ii) is started. Upon start of step (ii) of steam cleaning the door is again locked and steam is inserted into the oven cavity for a steam period of time $\Delta t_{steam2}$, here being from about 5 to about 15 min until the oven cavity reaches a temperature $T_3$, here being 90° C. Afterwards the oven cavity is incubated for an incubation period of time $\Delta t_{inc3}$, here being from about 15 to about 30 min including both a soaking phase and a cool down phase.

During said incubation period of time $\Delta t_{inc3}$, advantageously condensation of steam, particularly at the cavity walls is allowed, until a temperature $T_4$, here being 65° C. is reached in the cavity.

Now, advantageously condensation of steam at the oven cavity walls removes detergent residuals and remaining traces of soil The oven cavity is allowed to cool down to a working temperature $T_{work2}$, here being about 35° C. and the door lock is set open. The user is indicated by the user interface to open the door and remove water and dirt from the oven cavity. Hence, the user will open the door and mop the oven with a sponge, removing condensed water and residual dirt.

The result is a cavity cleaned by the inventive method, which was heavily soiled before conducting the inventive method.

It is immediately understood that by tuning temperatures $T_1$ and $T_2$, along with step durations, it is possible to create the ideal conditions for the detergent chemistry to elaborate soil.

Preferably, the method according to the invention is carried out as a semi-automatic program having set timing and temperatures. The skilled person should observe the following rules, to reapply the invention:

Step (i): The combination of time and temperature should allow to have a thoroughly soaking of the cavity, avoiding drying of the sprayed detergent during ($\Delta t_{inc1}$) at temperature $T_{act}$, and measuring the effectiveness of detergent and cycle action by a comparative cleaning test.

Step (ii): A combination of time and temperature should allow to have a thoroughly soaking of the cavity, final result should be benchmarked observing the final cleaning result and the residuals of detergent remaining in the oven.

Thereby it is immediately clear that the selection of ideal incubation temperatures also depends on the choice of the mild detergent. Standard mild basic detergents, for example, would benefit of higher temperatures, e.g. of 60° C. or more, while enzyme based detergents require lower temperatures of about 40° C. to 50° C., depending of the particular enzyme applied.

As may be immediately seen from the above, the present invention provides a solution which allows for an effective cleaning of a steam oven even in case of heavy soiling with an automatic or semi-automatic action of a user by creating tailored conditions for it.

With respect to existing steam assisted cleaning cycles, the effectiveness against heavy soiling is enhanced, and the possibility of automation of the process ensures consistency of the final result. Thereby, it should be seen that the integrated use of a mild detergent within a steam assisted oven cleaning cycle, maximizes the efficiency of the mild detergent and minimizes the manual effort needed to remove dirt even in case of heavy soiling.

The features of the present invention disclosed in the specification, the claims, and/or the figures may both separately and in any combination thereof be material for realizing the invention in various forms thereof.

The invention claimed is:

1. A method for cleaning a cavity of an oven having a steam generation device, comprising the following steps:

(i) a step of mild detergent cleaning, comprising:

(i.1) applying mild detergent to the oven cavity at a predetermined cavity starting temperature ($T_0$), and subsequently (i.2) incubating the oven cavity for a predetermined first incubation period of time ($\Delta t_{inc1}$) at a temperature $T_{act}$, (i.3) applying steam generated by the steam generation device to the oven cavity for both a first steam period of time ($\Delta t_{steam1}$) until the oven cavity reaches a temperature $T_1$ and a second incubation period of time ($\Delta t_{inc2}$) until the oven cavity reaches a temperature $T_2$ that is less than temperature $T_1$, and thereafter turning off the steam generation device such that the oven cavity cools to a first working temperature ($T_{work1}$), and (i.4) removing water and dirt from the oven cavity; and (ii) a step of steam cleaning, comprising:

(ii.1) applying steam generated by the steam generation device to the oven cavity for a second steam period of time ($\Delta t_{steam2}$) until the oven cavity reaches a temperature $T_3$, and subsequently incubating the oven cavity for a third incubation period of time ($\Delta t_{inc3}$) until the oven cavity reaches a temperature $T_4$, and (ii.2) removing water and dirt from the oven cavity.

2. The method according to claim 1, wherein the predetermined cavity starting temperature ($T_0$) is about room temperature and/or wherein $T_{act}$ is between about room temperature and about 60° C.

3. The method according to claim 1, wherein $T_1$ is equal to or less than about 100° C.

4. The method according to claim 3, $T_1$ being between about 50° C. and about 100° C.

5. The method according to claim 1, wherein $T_3$ is equal to or less than about 100° C.

6. The method according to claim 5, $T_3$ being between about 65° C. and about 100° C.

7. The method according to claim 1, wherein $T_2$ is higher than about 40° C.

8. The method according to claim 1, wherein $T_4$ is less than about 95° C. and/or higher than about 50° C.

9. The method according to claim 1, wherein substep ii.2 of removing water and dirt from the oven cavity is carried out subsequent to cooling the cavity to a second working temperature ($T_{work2}$).

10. The method according to claim 9, said second working temperature being about room temperature.

11. The method according to claim 1, wherein the mild detergent is selected from the group consisting of basic mild detergents and enzyme based mild detergents.

12. The method according to claim 1, wherein the mild detergent is a basic mild detergent comprising sodium hydroxide.

13. The method according to claim 1, wherein the mild detergent is a basic detergent and wherein the temperature $T_1$ and/or $T_2$ and/or $T_3$ and/or $T_4$ is higher than about 60° C.

14. The method according to claim 1, wherein the mild detergent is an enzyme and wherein the temperature $T_1$ and/or $T_2$ and/or $T_3$ and/or $T_4$ is each individually from about 40° C. to about 50° C.

15. The method according to claim 1, wherein a duration of the step (i) of mild detergent cleaning is about 35 min to 42 min, and the first incubation period $\Delta t_{inc1}$ is between about 200 sec and about 600 sec, and/or wherein the second incubation period $\Delta t_{inc2}$ is between 30 min and about 40 min, and/or wherein the first steam period $\Delta t_{steam1}$ is about 10 min.

16. The method according to claim 15, said first incubation period $\Delta t_{inc1}$ being between about 360 sec to about 600 sec.

17. The method according to claim 1, wherein a duration of the step (ii) of steam cleaning is about 20 min to about 45 min, and the third incubation period $\Delta t_{inc3}$ is between about 15 min and about 30 min and/or wherein the second steam period $\Delta t_{steam2}$ is about 500 s.

18. The method according to claim 1, said first working temperature being about room temperature.

19. The method according to claim 1, wherein the temperature $T_{act}$ is greater than the predetermined cavity starting temperature ($T_0$) and the temperature $T_1$ is greater than the temperature $T_{act}$.

20. The method according to claim 1, wherein the temperature $T_3$ is greater than the temperature $T_4$.

21. The method according to claim 1, wherein steam generated by the steam generation device is applied to the oven cavity intermittently during the second incubation period of time ($\Delta t_{inc2}$).

22. A method for cleaning a cavity of an oven having a steam generation device and a user interface, comprising the following steps:

a step of mild detergent cleaning, comprising:

(i.1) said user interface issuing a first message to apply mild detergent to the oven cavity, (i.2) a user manually applying said mild detergent to the oven cavity in response to said first message at a predetermined cavity starting temperature ($T_0$), (i.3) thereafter incubating the oven cavity for a predetermined first incubation period of time ($\Delta t_{inc1}$) at a temperature $T_{act}$, (i.4) thereafter applying steam generated by the steam generation device to the oven cavity for a first steam period of time ($\Delta t_{steam1}$) until the oven cavity reaches a temperature $T_1$, (i.5) thereafter incubating the oven cavity by supplying heat for a second incubation period of time ($\Delta t_{inc2}$) until the oven cavity reaches a temperature $T_2$ that is less than temperature $T_1$, (i.6) thereafter said user interface issuing a second message to remove water and dirt from the oven cavity, and (i.7) thereafter said user manually removing water and dirt from the oven cavity in response to said second message; and (ii) a step of steam cleaning, comprising:

(ii.1) applying steam generated by the steam generation device to the oven cavity for a second steam period of time ($\Delta t_{steam2}$) until the oven cavity reaches a temperature $T_3$, (ii.2) thereafter incubating the oven cavity for a third incubation period of time ($\Delta t_{inc3}$) until the oven cavity reaches a temperature $T_4$, (ii.3) thereafter said user interface issuing a third message to remove water and dirt from the oven cavity, and (ii.4) thereafter said user manually removing water and dirt from the oven cavity in response to said third message.

23. The method according to claim 22, said step (i) of mild detergent cleaning further comprising, before substep i.1, said user interface issuing a fourth message to open an oven door and thereafter said user manually opening said oven door in response to said fourth message and closing said oven door after applying said mild detergent.

24. The method according to claim 22, said step (i) of mild detergent cleaning further comprising before, substep i.6, said user interface issuing a fifth message to open said oven door and thereafter said user manually opening said oven door in response to said fifth message and closing said door after removing said water and dirt, and said step (ii) of steam cleaning further comprising, before said step ii.3, said user interface issuing a sixth message to open said oven door and thereafter said user manually opening said oven door in response to said sixth message.

25. The method according to claim 22, wherein during any of the first incubation period of time ($\Delta t_{inc1}$), the second incubation period of time ($\Delta t_{inc2}$), and the third incubation period of time ($\Delta t_{inc3}$), steam generated by the steam generation device is applied to the oven cavity.

26. The method according to claim 22, further comprising a substep of cooling the cavity to a first working temperature ($T_{work1}$) prior to substep (i.6) of said user interface issuing a second message to remove water and dirt from the oven cavity and subsequent to substep (i.5) of incubating the oven cavity by supplying heat for a second incubation period of time ($\Delta t_{inc2}$) until the oven cavity reaches a temperature $T_2$ that is less than temperature $T_1$.

* * * * *